US006440291B1

(12) United States Patent
Henri et al.

(10) Patent No.: US 6,440,291 B1
(45) Date of Patent: Aug. 27, 2002

(54) CONTROLLED INDUCTION BY USE OF POWER SUPPLY TRIGGER IN ELECTROCHEMICAL PROCESSING

(75) Inventors: Jon Henri, West Linn; John Floyd Ostrowski, Beverton, both of OR (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 09/727,431

(22) Filed: Nov. 30, 2000

(51) Int. Cl.[7] ..... C25D 5/34; C25D 5/00; C25D 21/12; C25D 11/32

(52) U.S. Cl. ..... 205/205; 205/81; 205/83; 205/157; 205/645; 205/687

(58) Field of Search ..... 205/205, 157, 205/81, 83, 645, 687

(56) References Cited

U.S. PATENT DOCUMENTS 6,261,433 B1 * 7/2001 Landau ..... 205/96

OTHER PUBLICATIONS

Mayer, Steve T., "Theories of Nucleation and Growth by Electrocrystalization", Lawrence Berkeley National Laboratories Report #LBL 28085, Chapter 4. Date Unavailable.

Alan West et al., "Pulse Reverse Copper Electrodeposition in High Aspect Ration Trenches and Vias", J. Electrochem. Soc., Sep. 1998., p. 3070.

Mayer, et al., "Method and Apparatus for Copper Pulse Electroplating", U.S. patent application Ser. No. 09/597,848, filed on Jun. 20, 2000.

* cited by examiner

*Primary Examiner*—Edna Wong
(74) *Attorney, Agent, or Firm*—Beyer Weaver & Thomas LLP

(57) ABSTRACT

Methods and apparatus are used for triggering and controlling an initial induction period in which a substrate is immersed in an electrochemical bath prior to actual electrochemical processing. This is accomplished by sensing a change in cell potential upon immersion of the substrate or a counter electrode in an electrochemical bath. Appropriate logic then holds the cell potential or current at a fixed value for a defined delay period. After that period ends, the logic allows the cell potential or current to increase to a level where electrochemical processing begins.

19 Claims, 4 Drawing Sheets

CONTROLLED INDUCTION BY USE OF POWER SUPPLY TRIGGER IN ELECTROCHEMICAL PROCESSING

FIELD OF THE INVENTION

This invention relates to methods for electrochemical processing of a substrate using copper or other metals. More specifically, the invention pertains to triggering and controlling an initial induction period in which the substrate is immersed in an electrochemical bath prior to actual electrochemical processing.

BACKGROUND OF THE INVENTION

Electroplating has many applications. One very important developing application is in plating copper onto semiconductor wafers to form conductive copper lines for "wiring" individual devices of the integrated circuit. Often this electroplating process serves as a step in the damascene fabrication procedure.

Generally, electroplating requires two principal conditions. First, the wafer or other substrate must be immersed in a plating solution. Second, a potential must be applied between the substrate and a counter electrodes, sufficient to initiate the flow of current between the two electrodes and cause electroplating.

In copper electroplating for damascene processing, the sequence and timing of these operations can have important repercussions in the ultimate quality of the plated copper. In one approach, the wafer to be plated is first immersed in the plating solution and then, after immersion, current is applied. The period between immersion and current application is referred to as "induction." In another approach, a potential is first applied to one of the electrodes, and then the "hot" wafer is immersed in the plating solution.

Each of these approaches has its own drawbacks. With the first approach, the induction period can be too long. Induction times of greater than about two seconds can lead to dissolution of a thin conductive copper "seed layer" typically applied to the wafer prior to plating. Seed layers are generally about 200 to 1500 angstroms thick and are applied by a physical vapor deposition (PVD) process. They are necessary to impart conductivity to the entire wafer active side and facilitate smooth even electroplating. The electroplating process itself provides a much thicker copper layer (about 1–2 micrometers thick) over the entire wafer active surface. During electroplating, cupric ions migrate through a conductive electroplating solution, deposit on the wafer active surface, and are reduced to form copper metal. To increase the overall conductivity of the electroplating solution, hydrogen ions are frequently added, often from dilute sulfuric acid.

While the nominal thickness of the copper seed layer is about 200 to 1500 angstroms, the actual thickness in certain damascene vias and trenches is generally much thinner, sometimes in the neighborhood of 50 to 100 angstroms. Obviously, plating solutions can aggressively attack the thin, delicate copper seed layer. If the induction period is too long (e.g., 2 to 4 seconds), the seed layer within damascene surface features will dissolve, leading to "voids" in the electroplated copper layer. Such voids may block electrical paths in an integrated circuit or at least reduce the conductance of the electrical path. As a result, individual integrated circuits, and possibly an entire wafer, may have to be discarded. Thus, uncontrolled induction can greatly reduce the yield of an integrated circuit fabrication process.

Unfortunately, available hardware and software for wafer plating provides inadequate mechanisms for determining when a wafer enters the plating bath. In one contemplated approach, the point at which a wafer is immersed in an electroplating solution is approximated using information from the mechanism that is used to lower the wafer into the electroplating solution. Specifically, an electric motor is used to drive a lead screw to which the semiconductor wafer is attached. The lead screw has a particular mark or index that approximates the level at which the wafer enters the plating solution. Given the variability in plating apparatus and plating solution height, this method is fairly inaccurate. Further, the feedback of this information to a controlling processor in the system typically employs a serial line, e.g., an RS-232 serial connection. There is an associated lag time in generating the signal from the lead screw until the signal is received by the controlling processor. Further, the controlling processor may have various other tasks in its queue ahead of handling such signal. All these effects introduce a variability of at least +/−0.5 seconds in detecting when a wafer enters a plating bath. Other methods are even cruder and less accurate. Therefore, there is currently no way to control the induction period to a point where seed layer dissolution is not a problem.

In the "hot entry" approach, electroplating begins immediately upon immersion of the wafer into the plating bath. So there is no induction period and dissolution of the seed layer is not a significant problem. But this approach produces other problems. The initial plating conditions are critical to obtaining high quality electroplated copper layers. Insufficient wetting and unpredictable convection patterns can lead to uncontrolled growth and generally poor electroplating. This, of course, leads to defects in the resulting integrated circuits and poor yields.

Typically, a wafer must be immersed in a solution for a certain amount of time before it has been fully wetted. Depending upon the characteristics of the plating bath and the wafer's active surface, adequate wetting may take between about 0.25 seconds and 1 second. If plating occurs before the surface is adequately wetted, there will be certain unwetted regions of the surface where no electroplating occurs, at least initially.

An additional problem arises because the wafer can be rotating during electroplating. It is usually rotating as it is immersed into the solution. The rotation and immersion process often generates bubbles that temporarily adhere to the wafer surface. Hence, the wafer should be immersed in the solution for a short period of time before plating begins. Otherwise, bubbles on the active surface will block electroplating in certain regions.

In view of the above issues, the technology of wafer introduction prior to electroplating requires improved systems and methods for preventing defects due to seed layer dissolution, uncontrolled growth, and other related problems.

SUMMARY OF THE INVENTION

The present invention provides methods and apparatus for triggering and controlling an initial induction period in which a substrate is immersed in an electrochemical bath prior to actual electrochemical processing. It accomplishes this by sensing a change in cell potential upon immersion of the substrate or a counter electrode in an electrochemical bath. Appropriate logic then holds the cell potential or current at a fixed value for a defined delay period. After that period ends, the logic allows the cell potential or current to increase to a level where electrochemical processing begins.

One aspect of this invention pertains to methods of controlling the induction period of a wafer in an electroplating solution prior to electroplating. This method may be characterized by the following sequence: (a) applying an entry voltage to the wafer or a counter electrode prior to immersing the wafer in the electroplating solution; (b) immersing the wafer in the electroplating solution while the entry voltage is applied; (c) determining that the entry voltage has passed to a trigger voltage; (d) waiting for a defined delay period after the time of the trigger voltage; and (e) beginning to electroplate the wafer after the delay period. Immersing the wafer in the electroplating solution causes the entry voltage to pass below the trigger voltage.

As mentioned, the invention finds particular use in the context of copper electroplating where the electroplating operation begins with a thin (between about 200 and 1500 angstroms) copper seed layer provided on the wafer's active surface. In this application, the goal is to prevent the seed layer from being dissolved by acid in the electrolyte.

Typically, the delay period will be between about 0.25 and 2 seconds, and more preferably between about 0.5 and 1.5 seconds. In a specific embodiment, the delay period is about 1 second. Typically, the system will maintain a hold current during the delay period. The size of the hold current may be chosen to prevent dissolution but prevent electroplating. In one example, the hold current magnitude is between about 0.05 amps and 0.25 amps. A typical entry voltage is between about 0.2 and 25 volts between the wafer and the counter electrode. In certain preferred embodiments, the trigger voltage is approximately one-half the value of the entry voltage. In a typical case, the trigger voltage is at least about 0.2 volts.

Another aspect of this invention pertains to apparatus for implementing the method of the invention. Included in the apparatus are components for the following: (a) detecting, applying, and controlling the described voltages and currents, (b) supporting and immersing the substrate into the plating bath, and (c) timing the events of the method.

In certain embodiments the apparatus may be characterized by the following elements: (a) a power supply having a current source and at least one of a voltage and a current sensor; and (b) associated logic for maintaining a hold current between the wafer and counter electrode for a defined delay period after determining that the wafer or counter electrode has been immersed in an electroplating solution. The voltage and/or current sensors sense voltage or current between wafer and the counter electrode in an electroplating apparatus. This allows the logic to control current and voltage in a manner consistent with this invention.

The associated logic may be implemented in any suitable manner. Often it will be implemented in computer hardware and associated software for controlling the operation of the computer. The logic initiates the delay period when it determines that the voltage between the wafer and the counter electrode drops below a predefined trigger level. After the delay period, the associated logic causes the voltage between the wafer and counter electrode to increase to a level at which electroplating occurs.

Typically, the power supply will include both a voltage sensor and a current sensor. In a specific embodiment, it can provide voltage in the range of about 0 to about 30 volts and provide current in the range of about 0 to about 30 amps.

These and other features and advantages of the present invention will be described in more detail below with reference to the associated figures.

BRIEF DESCRIPTION OF THE DRAWINGS

The following detailed description can be more fully understood when considered in conjunction with the drawings in which.

DETAILED DESCRIPTION OF THE PREFERRED EMBODIMENTS

In the following detailed description of the present invention, numerous specific embodiments are set forth in order to provide a thorough understanding of the invention. However, as will be apparent to those skilled in the art, the present invention may be practiced without these specific details or by using alternate elements or processes. For example copper electroplating on silicon wafers is described. The method could be implemented for any electroplating application using other metals or substrates employing a seed layer. In some descriptions herein, well-known processes, procedures and components have not been described in detail so as not to unnecessarily obscure aspects of the present invention.

The methods of the invention feature applying an entry voltage to the plating bath (anode) prior to immersion of the substrate (cathode). Upon reaching the bath the plating circuit is closed. Upon closure of the plating circuit, the applied voltage drops to a level below a defined trigger voltage. This voltage drop is used as a signal to apply a hold current sufficient to keep the seed layer from dissolving, but not sufficient to initiate electroplating. The substrate is immersed (and the hold current is applied) for enough time to ensure proper wetting of the substrate and dissipation of bubbles before applying sufficient current to initiate electroplating.

Figure 1:
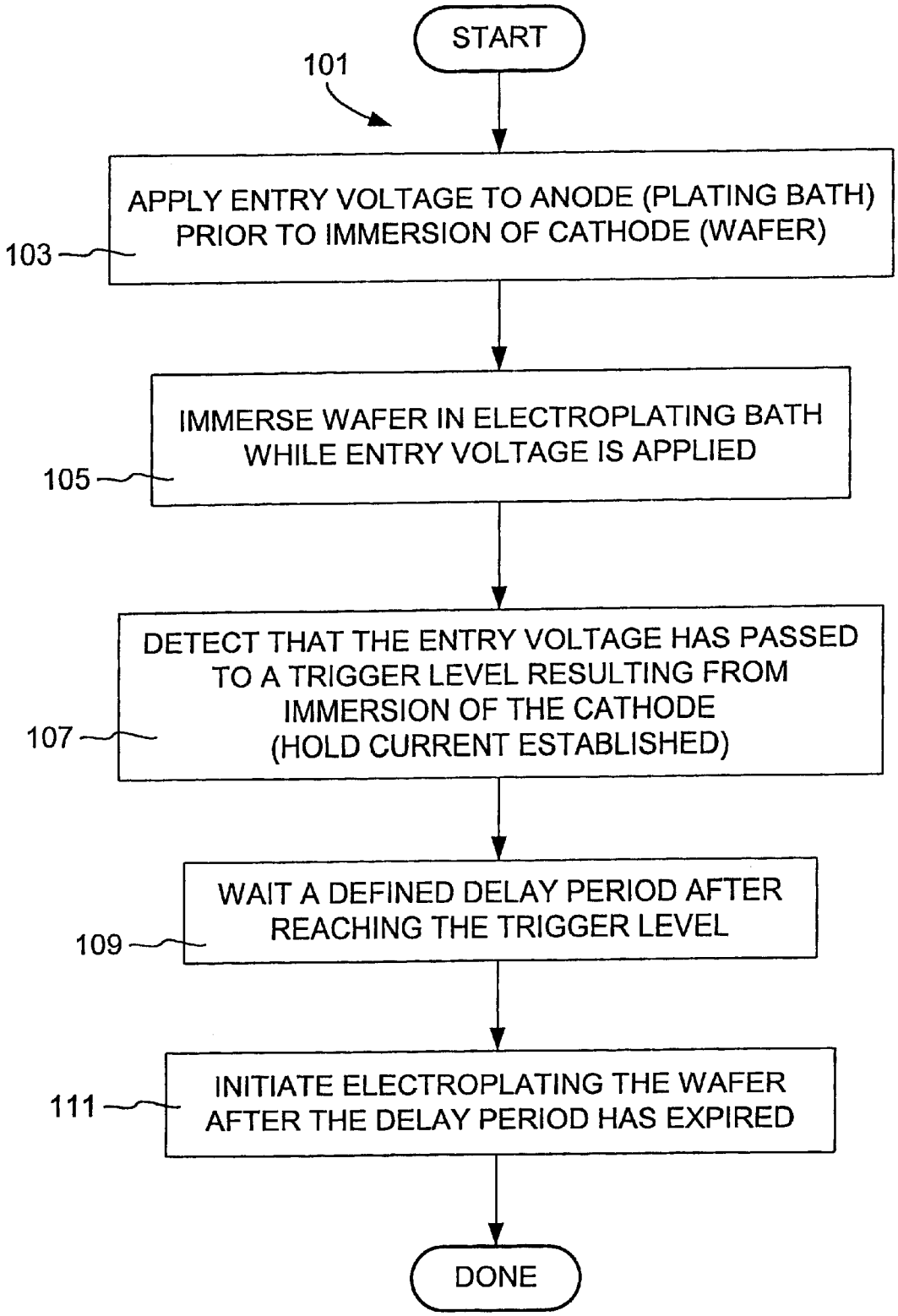
FIG. 1 is a flowchart of a method of controlling the induction period of a wafer in an electroplating solution prior to electroplating.

FIG. 1 summarizes the stages of a preferred embodiment of the method (101). First an entry voltage is applied (103) to the anode (plating bath) prior to immersion of the cathode (silicon wafer). Next the wafer is immersed while the entry voltage is applied (105). Once the wafer (cathode) makes contact with the plating solution (anode) the plating circuit is closed. This is because ions can now carry current between wafer and counter electrode. Once the plating circuit is closed, the entry voltage drops by an amount governed by the thermodynamics of the electroplating system. The control system is designed so that the voltage drop passes a defined trigger level. As part of the method 101, the system detects this drop at 107. At this time, in one example based on the chosen entry voltage applied and system thermodynamics, a hold current is established between the wafer and the counter electrode. Again, this hold current is sufficient to keep the seed layer from dissolving, but not sufficient to initiate electroplating. Alternatively, the method can be implemented such that upon detection of the trigger voltage level, the hold current is adjusted to a proper level independent of the initial potential applied to the anode. That is, based on the thermodynamics of the system, the resultant initially-established current via circuit closure may actually be zero or a level insufficient to define a hold current. In this case, the current is then adjusted to a proper hold current level. The wafer is immersed in the bath for a defined period of time sometimes referred to as the "delay period" (109).

This time is chosen to be long enough to ensure proper wetting of the wafer and dissipation of bubbles, but not so long that the seed layer dissolves. The length of this period may depend upon the value of the hold current. Shorter delay periods may be required when the electrode potential/current is such that the seed layer dissolves rapidly. Finally, after the delay period has elapsed, a sufficient current is applied to initiate electroplating (111).

Figure 2:
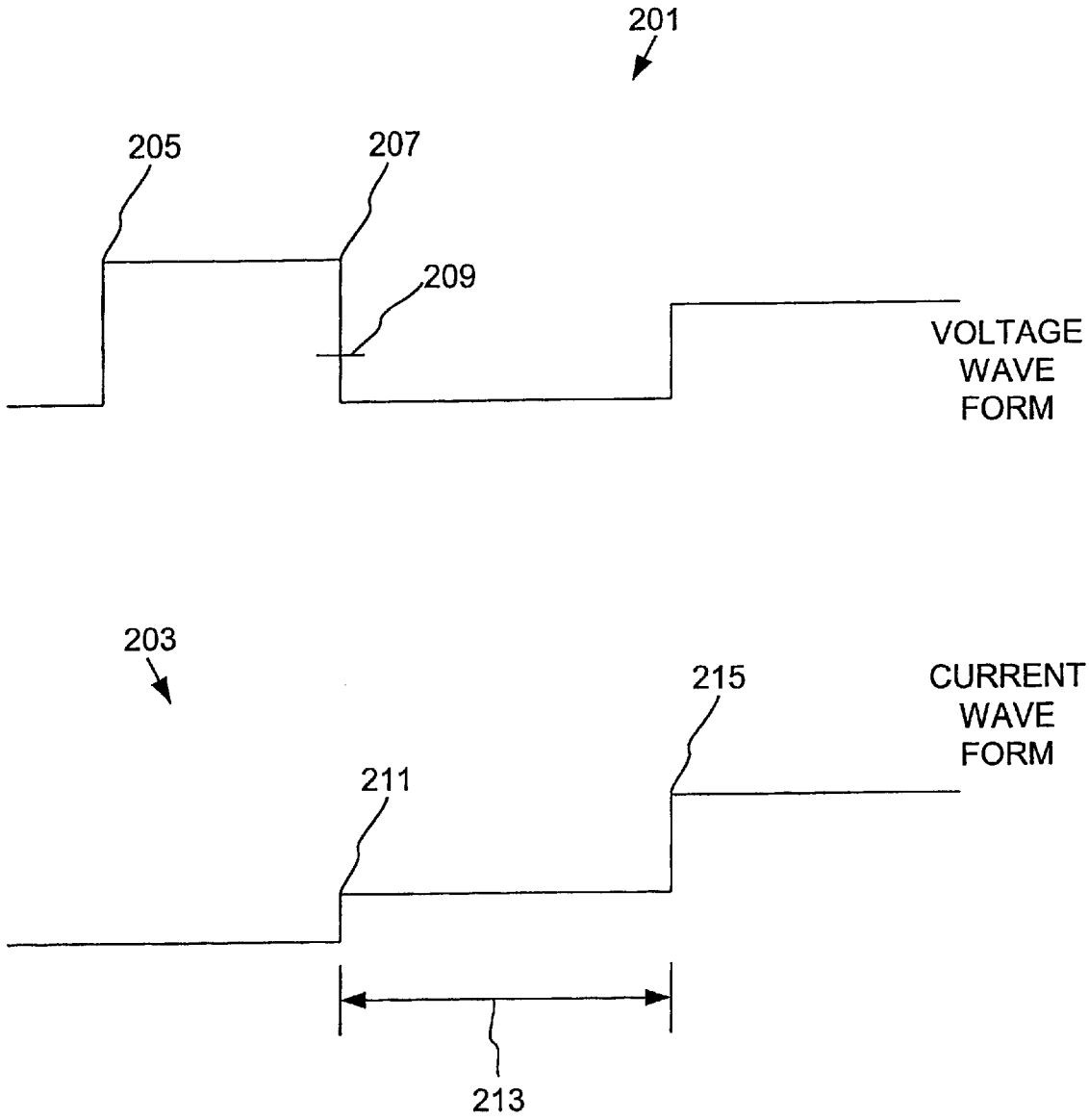
FIG. 2 is a timing diagram depicting voltage and current waveforms useful for controlling an induction period in accordance with an embodiment of this invention.

FIG. 2 is a timing diagram depicting applicable voltage (201) and current (203) waveforms for the method. Note that timing of the waveforms is synchronous. Initially an entry voltage level is applied (205), for a defined period of time, during which the wafer is being brought to the plating bath and no current is flowing. As mentioned, the entry voltage is chosen to be a value, in one case, sufficient to establish a defined hold current based on the thermodynamics of the electroplating circuit once closed. Alternatively, the entry voltage is chosen such that the current level established upon circuit closure is below a desired hold level and the hold level is subsequently established via current adjustment. Entry voltage levels are determined considering the specific plating system used. Entry voltages can be in the range of 0.2 to 25 volts. Preferably, the entry voltage will be between 0.2 and 1.0 volts, typically about 0.5 volts. The entry voltage is held for a period until coming in contact with the plating bath. The time held is determined by considering the events that must take place prior to immersion of the wafer in the electroplating bath and the time needed to execute said events. Such events include any hardware or software adjustments or settings that take place during the time the wafer is physically moved to the electroplating bath. Once the wafer comes in contact with the bath (207) the voltage drops below a trigger level (209). The trigger level voltage value is chosen to be a value sufficient to be detected given the resistance of the plating bath. That is, the change in voltage from the entry voltage to the trigger level must be sufficient to be detected given the resistance of the plating bath. The trigger voltage can be as low as 0.2 volts. In one embodiment, the trigger voltage level is chosen arbitrarily to be one-half the entry voltage. The plating circuit is closed and a hold current (211) is established, vida infra. The hold current is at least about 0.05 amps, although a typical range is between about 0.05 amps and 0.25 amps. This current level is held for a defined period (213), the delay period. As mentioned, the delay period is chosen to sufficiently wet the wafer and disperse any bubbles. The delay period is typically between about 0.25 seconds and 2 seconds, but more often between about 0.5 seconds and 1.5 seconds. Preferably the delay period is about 1 second. When the delay period ends (215) a current is applied sufficient to start electroplating.

Figure 3:
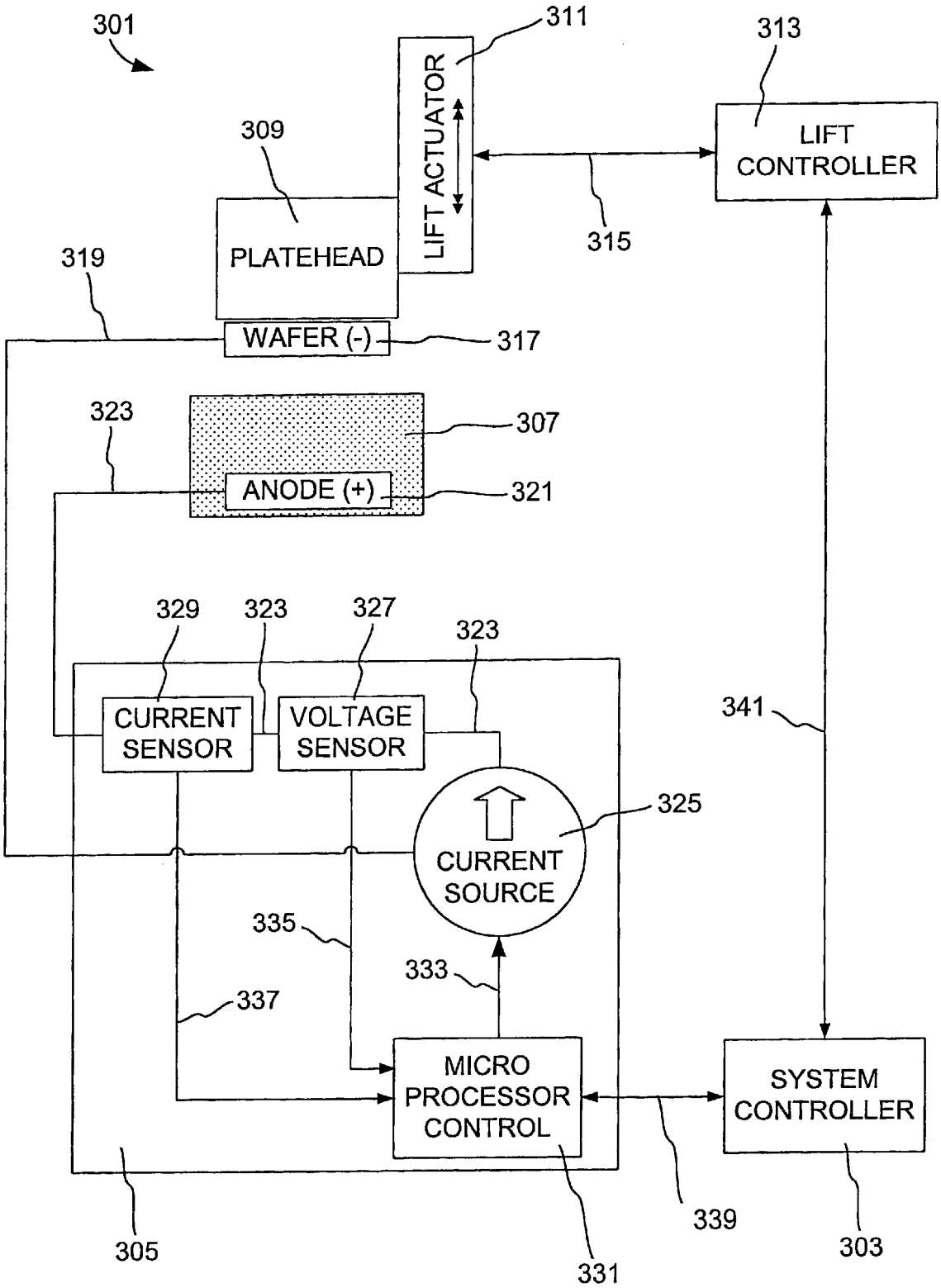
FIG. 3 is a block diagram of an apparatus suitable for implementing the method.

FIG. 3 shows a block diagram of an apparatus 301 for implementation of a preferred embodiment of the method. Individual components of the depicted apparatus can be purchased commercially. Their configuration and programming constitute novelty. Major components of the apparatus are system controller 303, power supply 305, plating bath 307; and a system to raise and lower the wafer into the plating bath made up of platehead 309, lift actuator 311, and lift controller 313. The lift actuator and lift controller communicate via connection 315. The platehead is raised and lowered by lift actuator 311, which in turn is controlled by lift controller 313. The platehead holds (and can rotate) a silicon wafer or other substrate for immersion into the plating bath. In this case, the anode is submersed in the plating bath and the cathode is a silicon wafer upon which copper will be electroplated.

System controller 303 coordinates power supply function with electrode position events. In this example the system controller is an appropriately programmed computer and the power supply is a commercially available unit equipped with its own internal microprocessor for precise control of the voltage, current, and timing events. Alternatively, the power supply functions can be entirely controlled by computer. The logic associated with detecting a voltage-drop triggering event, maintaining a hold current between electrodes for a defined time period, and coordinating these events for the purpose of electroplating is integral to the invention. The cathode, in this case wafer 317, is connected to power supply 305 via line 319. Anode 321 is connected to power supply 305 via line 323 and is located in electroplating bath 307. In the case of copper electroplating, the anode is commonly made of copper metal and the bath is a solution of cupric sulfate or other suitable copper salt. As mentioned, to increase the overall conductivity of the electroplating solution, hydrogen ions are frequently added, often in the form of dilute sulfuric acid. Wafer 317 and anode 321 are connected to current source 325 via lines 319 and 323, respectively. Voltage and current are monitored with voltage sensor 327 and current sensor 329 via power line 323. Current source 325 is controlled by microprocessor 331 via connection 333. Voltage sensor 327, and current sensor 329 send signals to the microprocessor via lines 335 and 337, respectively. System controller 303 is a key component in the apparatus, because it coordinates and controls power supply functions (via 339) and lift controller functions (via 341).

For further clarity, a more detailed description of a specific embodiment of the method is provided with reference to FIG. 3. Typically, a silicon wafer of 100, 150, 200, or 300 millimeters is used. Also in the preferred embodiment the wafer has been precoated with a copper seed layer deposited using PVD. The seed layer has a nominal thickness of between about 200 and 1500 angstroms. After the wafer is placed into platehead 309, system controller 303 transmits entry voltage, hold current, trigger voltage, delay time, and plating current parameters to power supply 305. As mentioned, the entry voltage can be 0.5 volts and the trigger voltage one-half of the entry voltage, in this case 0.25 volts. The hold current is typically about 0.1 amps. The power supply must be able to deliver voltage and current accurately within 50 millivolts and 50 milliamps, respectively. The power supply configures current source 325 to provide the entry voltage and hold current; monitoring for the trigger voltage event begins concurrently. The power supply replies to the system controller that it has completed the requested operations. Upon receipt of the reply from the power supply, the system controller commands lift controller 313 to move lift actuator 311 to the plating location. As mentioned, system controller 303 can also handle all power supply commands directly. The lift controller then begins moving the platehead containing wafer 317 (the cathode) to plating bath 307. When the lift controller reaches the plate position it replies to the system controller that the motion is complete. At some point during the motion to the plating position, the wafer makes contact with the electrolyte solution. This event closes the open circuit that existed between the cathode and the anode. Upon closure of the plating circuit, the voltage drops to a level below the trigger voltage value. With this trigger event, the delay timer is started. The delay period can be as short as 0.25 seconds and as long as 2 seconds, more preferably between 0.5 and 1.5 seconds, most preferably about 1 second. When the delay period is over the power supply begins delivering the plating current.

Again, as will be apparent to those skilled in the art, the present invention may be practiced without these specific details or by using alternate elements or processes. Although copper electroplating on silicon wafers is described, the method could be implemented for any electroplating application using metals, with substrates having seed layers.

Generally, embodiments of the present invention employ various processes involving data stored in or transferred through one or more computer systems (e.g., system controller 303). Embodiments of the present invention also relate to the apparatus for performing these operations (e.g., system controller 303). This apparatus may be specially constructed for the required purposes, or it may be a general-purpose computer selectively activated or reconfigured by a computer program and/or data structure stored in the computer. The processes presented herein are not inherently related to any particular computer or other apparatus. In particular, various general-purpose machines may be used with programs written in accordance with the teachings herein, or it may be more convenient to construct a more specialized apparatus to perform the required method steps.

In addition, embodiments of the present invention relate to computer readable media or computer program products that include program instructions and/or data (including data structures) for performing various computer-implemented operations. Examples of computer-readable media include, but are not limited to, magnetic media such as hard disks, floppy disks, and magnetic tape; optical media such as CD-ROM disks; magneto-optical media; semiconductor memory devices, and hardware devices that are specially configured to store and perform program instructions, such as read-only memory devices (ROM) and random access memory (RAM). The data and program instructions of this invention may also be embodied on a carrier wave or other transport medium. Examples of program instructions include both machine code, such as produced by a compiler, and files containing higher level code that may be executed by the computer using an interpreter.

Figure 4:
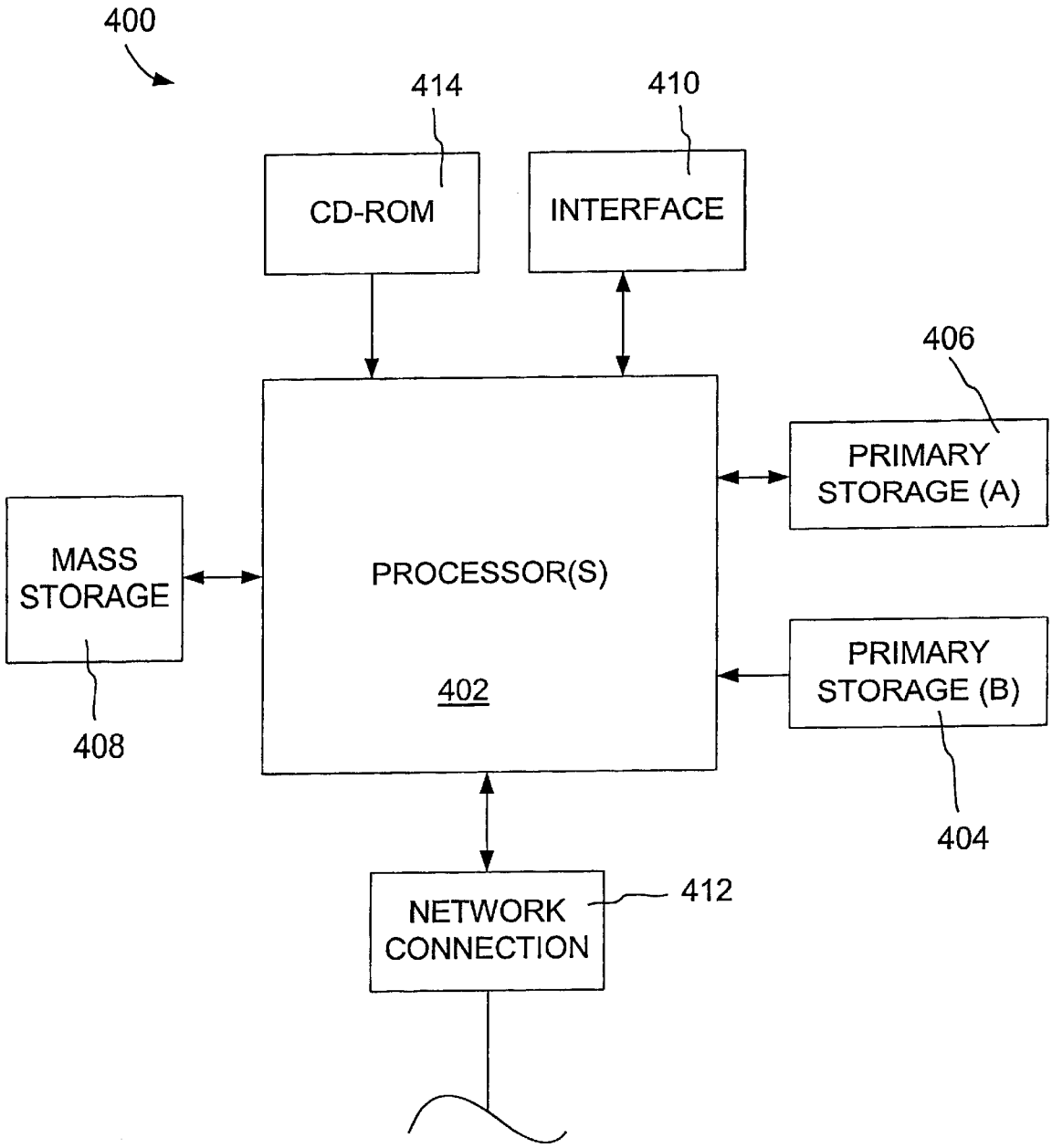
FIG. 4 is a block diagram of a computer system that may be used to implement various aspects of this invention such as determining immersion and controlling the delay period.

FIG. 4 illustrates a typical computer system that, when appropriately configured or designed, can serve as a power supply controller of this invention. The computer system 400 includes any number of processors 402 (also referred to as central processing units, or CPUs) that are coupled to storage devices including primary storage 406 (typically a random access memory, or RAM), primary storage 404 (typically a read only memory, or ROM). CPU 402 may be of various types including microcontrollers and microprocessors such as programmable devices (e.g., CPLDs and FPGAs) and unprogrammable devices such as gate array ASICs or general purpose microprocessors. As is well known in the art, primary storage 404 acts to transfer data and instructions uni-directionally to the CPU and primary storage 406 is used typically to transfer data and instructions in a bi-directional manner. Both of these primary storage devices may include any suitable computer-readable media such as those described above. A mass storage device 408 is also coupled bi-directionally to CPU 402 and provides additional data storage capacity and may include any of the computer-readable media described above. Mass storage device 408 may be used to store programs, data and the like and is typically a secondary storage medium such as a hard disk. It will be appreciated that the information retained within the mass storage device 408, may, in appropriate cases, be incorporated in standard fashion as part of primary storage 406 as virtual memory. A specific mass storage device such as a CD-ROM 414 may also pass data uni-directionally to the CPU.

CPU 402 is also coupled to an interface 410 that connects to one or more input/output devices such as such as video monitors, track balls, mice, keyboards, microphones, touch-sensitive displays, transducer card readers, magnetic or paper tape readers, tablets, styluses, voice or handwriting recognizers, or other well-known input devices such as, of course, other computers. Finally, CPU 402 optionally may be coupled to an external device such as a database or a computer or telecommunications network using an external connection as shown generally at 412. With such a connection, it is contemplated that the CPU might receive information from the network, or might output information to the network in the course of performing the method steps described herein.

Typically, the computer system 400 is directly coupled to a power supply and other components of an electroplating apparatus of this invention. Data from current and voltage sensors is provided via interface 412 for analysis by system 400. With this data, the apparatus 400 can issue various control commands such as maintaining a hold current for the delay period.

While this invention has been described in terms of a few preferred embodiments, it should not be limited to the specifics presented above. Many variations on the above-described preferred embodiments may be employed. For example, the invention may be applied to trigger and control a delay period required for electropolishing or electroplanarization processes. In such cases, the wafer serves as the anode and the counter electrode is the cathode. Therefore, the invention should be broadly interpreted with reference to the following claims.

What is claimed is:

1. A method of controlling the induction period of a substrate in an electrolytic solution prior to electrochemical processing, the method comprising:

(a) applying an entry voltage to the substrate or a counter electrode prior to immersing the substrate or counter electrode in the electrolytic solution;

(b) immersing the substrate or counter electrode in the electrolytic solution while the entry voltage is applied;

(c) determining that the entry voltage has passed to a trigger voltage, which passage resulted from immersion of the substrate or counter electrode in the electrolytic solution;

(d) waiting for a defined delay period after the time of the trigger voltage; and (e) initiating electrochemical processing of the substrate after the delay period.

2. The method of claim 1, wherein the substrate is a silicon wafer or partially fabricated integrated circuit.

3. The method of claim 2, wherein the silicon wafer or partially fabricated integrated circuit is electroplated with copper during (e).

4. The method of claim 2, wherein the silicon wafer or partially fabricated integrated circuit contains a copper seed layer over its active surface.

5. The method of claim 4, further comprising maintaining a hold current during the delay period, which hold current prevents dissolution of the copper seed layer.

6. The method of claim 5, wherein the hold current is at least about 0.05 amps.

7. The method of claim 5, wherein the hold current is between about 0.05 amps and 0.25 amps.

8. The method of claim 4, wherein the seed layer has a nominal thickness of between about 200 and 1500 angstroms.

9. The method of claim 2, wherein the entry voltage is at least about 0.2 volts between the silicon wafer or partially fabricated integrated circuit and the counter electrode.

10. The method of claim 9, wherein the entry voltage is between about 0.2 and 25 volts between the silicon wafer or partially fabricated integrated circuit and the counter electrode.

11. The method of claim 1, further comprising maintaining a hold current during the delay period, which hold current is insufficient for electroplating.

12. The method of claim 11, wherein the hold current is at least about 0.05 amps.

13. The method of claim 11, wherein the hold current is between about 0.05 amps and 0.25 amps.

14. The method of claim 1, wherein the electrolytic solution contains acid.

15. The method of claim 1, wherein the trigger voltage is at least about 0.2 volts.

16. The method of claim 1, wherein the trigger voltage is approximately one-half the value of the entry voltage.

17. The method of claim 1, wherein the delay period is between about 0.25 and 2 seconds.

18. The method of claim 17, wherein the delay period is between about 0.5 and 1.5 seconds.

19. The method of claim 18, wherein the delay period is about 1 second.

* * * * *